United States Patent [19]

Lagerstedt et al.

[11] Patent Number: 4,580,953

[45] Date of Patent: Apr. 8, 1986

[54] SCREW PUMP INCLUDING A FLUID BYPASS REGULATING DEVICE

[75] Inventors: Torgny J. Lagerstedt, Stockholm; Bo G. Johansson, Skärholmen, both of Sweden

[73] Assignee: Imo Aktiebolag, Stockholm, Sweden

[21] Appl. No.: 632,834

[22] Filed: Jul. 20, 1984

[30] Foreign Application Priority Data

Jul. 20, 1983 [SE] Sweden ..... 8304068

[51] Int. Cl.[4] ..... F04B 23/00; F04C 2/00

[52] U.S. Cl. ..... 417/440; 418/15; 418/180; 418/197; 418/201

[58] Field of Search ..... 417/440; 418/15, 180, 418/197, 201, 102

[56] References Cited

U.S. PATENT DOCUMENTS

| | | | |
|---|---|---|---|
| 3,103,894 | 9/1963 | Sennet | 418/197 |
| 3,291,061 | 12/1966 | Shinohara | 418/180 X |
| 3,408,114 | 10/1968 | Blackwell | 418/201 X |
| 3,574,488 | 4/1971 | Vanderstegen Drake | 418/201 X |
| 3,809,510 | 5/1974 | Gregerson et al. | 417/440 X |
| 3,975,123 | 8/1976 | Schibbye | 418/102 X |
| 4,005,949 | 2/1977 | Grant | 418/180 X |
| 4,375,156 | 3/1983 | Shaw | 418/102 X |

FOREIGN PATENT DOCUMENTS

| | | | |
|---|---|---|---|
| 801560 | 1/1951 | Fed. Rep. of Germany | 417/440 |
| 879208 | 6/1953 | Fed. Rep. of Germany | 418/197 |
| 1920628 | 10/1969 | Fed. Rep. of Germany | 418/15 |
| 853166 | 11/1939 | France | 418/180 |
| 1245463 | 9/1960 | France | 418/197 |
| 14888 | 2/1981 | Japan | 418/201 |
| 404056 | 1/1934 | United Kingdom | 418/180 |
| 2008684 | 6/1979 | United Kingdom | 418/15 |
| 2093915 | 9/1982 | United Kingdom | 418/180 |
| 502123 | 4/1976 | U.S.S.R. | 418/201 |

*Primary Examiner*—William L. Freeh
*Assistant Examiner*—Paul F. Neils
*Attorney, Agent, or Firm*—Banner, Birch, McKie & Beckett

[57] ABSTRACT

A screw pump of the kind including a screw array consisting of a central screw (1) with convex flanks and one or more side screws (2) with concave flanks, the threads being formed such that coacting screws seal against each other with the screw array being sealingly surrounded by a screw housing (3), so that at least one closed chamber is formed by the sides and roots of the threads as well as the screw housing, the chamber migrating axially from the inlet end of the screw array to its outlet end when the screws are turned, and is in communication at least during a portion of its migration with a pressure fluid source (9) via at least one duct (14) made in the pump. To prevent the occurrence of, and to eliminate, existing air and gas bubbles in the liquid chamber without efficiency being unnecessarily deteriorated, the pump is provided with a regulating device (15) coacting with the duct for adjusting the quantity of liquid flowing to the chamber from the pressure fluid source.

4 Claims, 2 Drawing Figures

SCREW PUMP INCLUDING A FLUID BYPASS REGULATING DEVICE

BACKGROUND OF THE INVENTION

1. Field of the Invention

The present invention relates to a screw pump containing a screw array comprising a central screw with convex flanks and one or more side screws with concave flanks, in which the threads have a form such that coacting screws seal against each other simultaneously as all screws are sealingly contained in a housing.

2. Description of the Prior Art

When such a pump is in operation, liquid is transported axially from the inlet or suction side of the screw array to its outlet or pressure side in closed chambers, which are formed by the flanks and roots of the screws and the surrounding housing. Such a chamber is formed at the suction side of the screw array, when the driving screw is rotated, and filled with liquid as it is formed. When the chamber is completely formed, it is closed on the suction side and continues, for continued rotation of the driving screw, axially towards the outlet side of the screw array where it opens and the liquid is discharged. The volume of the chamber is unaltered during the whole transport from inlet to outlet side, and providing the pump is ideally sealed, the liquid in the chamber is at the pressure prevailing at the inlet during the whole of this transport, and not until it arrives at the outlet is it given the higher pressure prevailing there. In a practical pump of this kind there is always some interior leakage of course, due to unavoidable manufacturing tolerances, which result in a given clearance between the screws themselves and between the screws and the housing, and there is thus a small pressure increase during transport through the screw array. With sufficient accuracy in manufacture this pressure increase will be so little, however, that substantially the whole of the pressure increase takes place at the outlet.

A sub-pressure occurs when the chamber is formed, resulting in that it is filled with liquid. If rotation takes place at a rate falling below a given critical value, the chamber is filled completely with liquid. This critical value depends on the geometrical dimensions and implementation of the screws, the configuration of the inlet, the properties of the liquid pumped, e.g. its viscosity, pressure of vaporization and its content of dissolved gases, and the suction height. If the revolutional rate exceeds the critical value there is no time for the chamber to be filled entirely, and cavities are formed in the liquid which are filled with gas or air dissipated by the pumped liquid. These gas or air bubbles and the air bubbles which the liquid contains when it is fed into the pump accompany the liquid during its transport in the screw array from the inlet to the outlet side. When the chamber is opened to the outlet side and the liquid is suddenly subjected to the pressure prevailing there, the gas and air bubbles will be rapidly compressed, i.e. they implode. This results in noise and vibrations which can be very disturbing and can also cause damage to the pump and other components in the installation.

In order to reduce these effects of cavitation so that it will be possible to drive the pump at a rate of revolutions exceeding the critical rate at which cavities normally occur, it has been arranged that each chamber during its migration is in communication with the pressure side of the pump via a narrow duct, such that the pressure in each individual chamber during transport from the inlet to the outlet side is continuously raised from the value at the inlet side to the value at the outlet side (see the French Pat. No. 1245463). The result of this is that the gas and air bubbles are successively compressed, thereby avoiding the sudden implosion of bubbles at the outlet side.

It has also been attempted to reduce the mentioned effects of cavitation by making a groove in at least one of the flanks of one of the screws, this groove forming a helical duct throughout the screw array, and when the groove is made in the flank of a side screw, it is within the transition between the concave flank and the cylindrical circumferential surface of the thread, and when it is made in the central screw outside the transition between the concave flank and the cylindrical bottom surface of the thread (see the Swedish Pat. No. 199 274).

A disadvantage with these previously known embodiments is that return leakage in the pump increases, and the increase in revolutional rate which is dependent on the size of the duct thus takes place at the expense of sealing. Furthermore, return leakage takes place continuously or successively mainly along the whole length of the screw array, which adversely affects efficiency. Another disadvantage is that the amount of liquid which is supplied to the chambers by return leakage or by liquid supply via the duct cannot be adjusted to different operational conditions, resulting in that the pump most often operates with poor efficiency. A further disadvantage is that providing the duct makes manufacture of the otherwise complicated screw even more complicated.

SUMMARY OF THE INVENTION

One object of the present invention is to do away with the disadvantages of screw pumps known to the art and to provide a screw pump which not only reduces the effects of cavitation so that it will be possible to operate the pump at revolutional rates exceeding the critical rate at which cavities occur, but is also implemented so that return leakage is limited, as well as being adjusted to different operating conditions, whereby the volumetric efficiency will be high, as well as the pump being simple and cheap to manufacture.

This object is achieved by the screw pump in accordance with the invention being given in the characterizing features disclosed in the claims.

DETAILED DESCRIPTION OF THE PREFERRED EMBODIMENT

Figure 1:
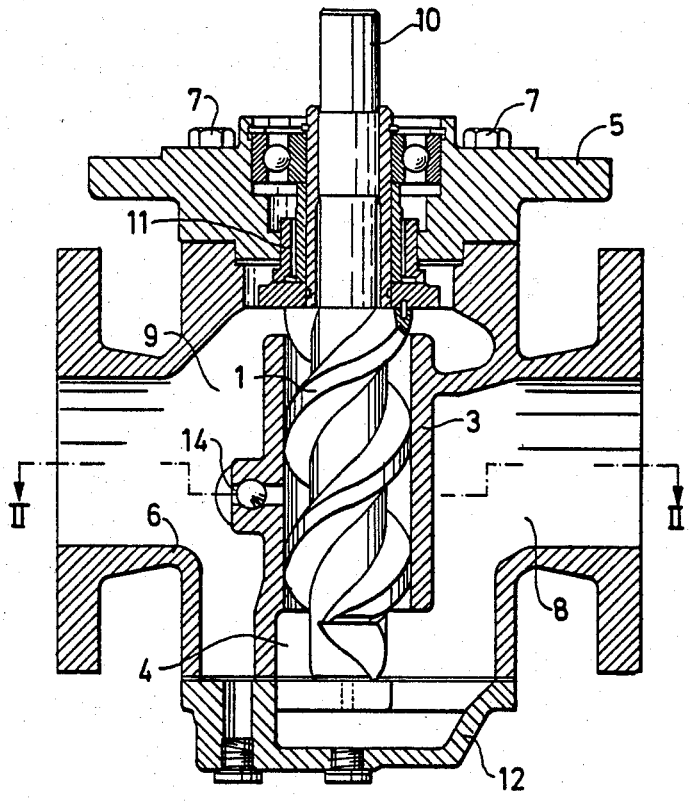
FIG. 1 is a partially cut-away side view of a screw pump in accordance with the invention and FIG. 2 is a cross-section substantially along the line II—II in FIG. 1.

The screw pump illustrated on the drawings is of the type having a driven central screw 1 and two side screws 2. The central screw 1 is two-start, with convex flanks, and the side screws 2 are similarly two-start but with concave flanks, the threads being conventionally implemented so that they seal against each other. The screw array formed by the central screw 1 and the side screws 2 is contained in a housing 3 tightly sealing against the array, the housing being provided at its lower end in FIG. 1 with an opening 4 through which the inlet to the screw array takes place. The housing 3 forms a part of a pump housing 6 with a cover 5 attached by screws 7 at the housing's upper end. The lower end of the screw housing 3 with the opening 4 is in the inlet chamber 8 of the pump housing 6, while the upper end of the screw housing 3 which is open axially and forms the outlet from the screw array, is in the outlet chamber 9 of the pump housing 6.

The central screw 1 is arranged to be driven, and for this purpose it is formed with an integral drive shaft 10 journalled in a bearing housing 11 attached to the cover 5 and extends from there through the cover for connection to an unillustrated drive motor. The lower ends of the screws are formed as stub shafts and mounted in a lower end wall member 12 attached to the pump housing 6.

For compressing the air or gas bubbles which are formed in the liquid when the critical revolutional rate is exceeded and/or which already are in the liquid when it is fed into the pump, there has been made a duct in the screw housing 3, in accordance with the invention, in the form of a bore 14 extending between the outlet chamber 9 and the space inside the screw housing in which the drive screw 1 rotates. The bore 14 is suitably made close to the lower part of the screw housing 3 in FIG. 1 where a liquid chamber is formed. There is thus achieved that this liquid chamber is given a pressure exceeding the pressure on the inlet side. By regulating the pressure in the liquid chamber in a manner described below, air and gas bubbles are compressed to a desired extent so that no implosion with accompanying noise and vibration occurs at the outlet side, whereby the revolutional rate can be kept above the critical value without any inconvenience.

The diameter of the bore 14 is selected such that a liquid flow which is sufficient for preventing the occurrance of, and eliminating, existing air and gas bubbles, can be taken into the liquid chamber, whereby maximum compressive effect is achieved. So that optimum volumetric efficiency will be obtained at different pump revolutions and operational loads, as well as for liquids with different viscosities and gas and air content, the liquid quantity flowing through this bore is decreased to an extent which is adjusted to these factors and which is directly dependent on the conditions under which the pump operates.

Figure 2:
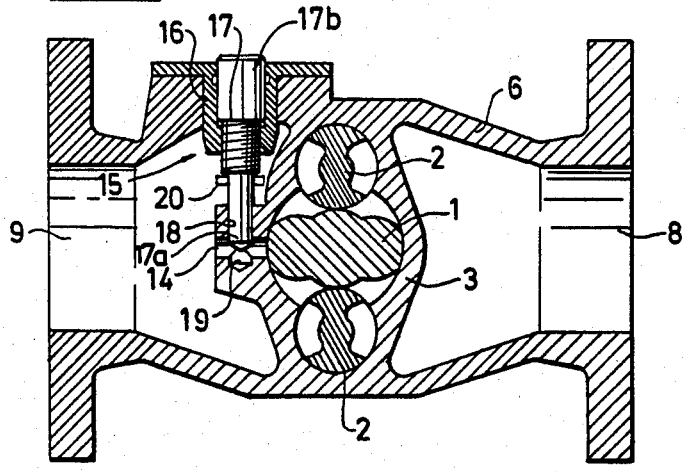

Regulation of the amount of liquid passing through the bore 14 is achieved by a regulating device 15 arranged in the pump housing 6, and includes a sleeve 16 seated in the pump housing, and threaded to suit a valve spindle 17. The spindle 17 extends through a bore 18 in the pump housing 3 and with its forward end 17*a* thrusts into the bore 14. The spindle is axially displaceable by turning its end 17*b*, which is accessable from outside the pump housing, between a bottom end position in FIG. 2 wherein the forward end 17*a* is partially received in a bore 19 coaxial with the bore 18, thus closing off the bore 14 entirely, and an upper end position in FIG. 2 in which the forward end leaves the bore 14 entirely free, while a stop 20 on the spindle engages against the sleeve 16.

By adjusting the device 15 so that the quantity of liquid flowing through the bore 14 is suited to the properties of the pumped liquid and to the operational conditions of the pump there is ensured vibration- and noise-free operation with optimum efficiency of the pump.

Although only one embodiment of the invention has been described above and illustrated on the drawings, it should be understood that the invention is not limited to this embodiment but is only restricted by the disclosures in the claims.

What is claimed as new and desired to be secured by Letters Patent of the United States:

1. A liquid screw pump including a pump housing having an inlet chamber and an outlet chamber, a screw array rotatably mounted within said housing and having an inlet end and an outlet end, said array comprising a central screw (1) with roots and convex thread flanks and at least one side screw (2) with roots and concave thread flanks, the threads of said screws being formed such that coacting screws seal against each other, a screw housing (3) within said pump housing sealingly surrounding said screw array, at least one liquid chamber being formed by said thread flanks and roots in cooperation with said screw housing, said liquid chamber migrating axially from said inlet end of the screw array to said outlet end when said screws are turned, a duct (14) formed in said screw housing, said duct communicating with said outlet chamber of said pump housing to place at least a portion of said liquid chamber in communication with the pressurized liquid within said outlet chamber, and a regulating device (15) mounted in association with said duct (14) for adjusting the quantity of liquid flowing to said liquid chamber from said outlet chamber whereby pump noise and vibration caused by excessive cavitation-causing revolutions of said screw array or gas bubbles in the liquid are minimized.

2. A liquid screw pump as claimed in claim 1, characterized in that said duct (14) is formed in the screw housing (3) and extends from said outlet chamber at said outlet end of said screw array (1, 2) to said liquid chamber in the vicinity of said inlet end of said screw array when said liquid chamber is at least partially already formed.

3. A liquid screw pump as claimed in claim 1 or 2, characterized in that said regulating device comprises a manually operable regulating valve (15) accessible from the outside of said pump.

4. A liquid screw pump as claimed in claim 1, characterized in that said duct is formed as a bore (14) in which a part (17*a*) of said regulating device (15) is displaceably disposed.

* * * * *